US005345676A

United States Patent [19]

Ashley, Jr.

[11] Patent Number: 5,345,676

[45] Date of Patent: Sep. 13, 1994

[54] METHOD FOR PRODUCING A FULL FACE FABRICATED VEHICLE WHEEL

[75] Inventor: Walter L. Ashley, Jr., Detroit, Mich.

[73] Assignee: Hayes Wheels International, Inc., Romulus, Mich.

[21] Appl. No.: 144,164

[22] Filed: Oct. 27, 1993

Related U.S. Application Data

[63] Continuation-in-part of Ser. No. 54,373, Apr. 28, 1993, Pat. No. 5,295,304.

[51] Int. Cl.[5] ..... B21K 1/28

[52] U.S. Cl. ..... 29/894.323; 29/894.325; 29/DIG. 32; 301/63.1

[58] Field of Search ..... 29/894.32, 894.322, 29/894.323, 894.325, DIG. 32; 72/68; 301/63.1

[56] References Cited

U.S. PATENT DOCUMENTS

| | | | |
|---|---|---|---|
| 2,075,294 | 3/1937 | LeJeune | 301/63.1 |
| 2,975,511 | 3/1961 | Johnson | 29/894.325 |
| 2,983,033 | 5/1961 | Cox | 29/894.325 |
| 3,195,491 | 7/1965 | Bulgrin et al. | 29/894.325 |
| 3,262,191 | 7/1966 | Albertson et al. | 29/894.325 |
| 3,823,591 | 7/1974 | Schroder et al. | 29/894.325 |
| 4,610,482 | 9/1986 | Overbeck et al. | 301/63.1 |
| 5,257,455 | 11/1993 | Iwatsuki | 29/894.323 |

FOREIGN PATENT DOCUMENTS 6478901 3/1989 Japan ..... 301/63.1

*Primary Examiner*—P. W. Echols

*Attorney, Agent, or Firm*—MacMillan, Sobanski & Todd

[57] ABSTRACT

An improved method for producing a full face fabricated vehicle wheel is disclosed, wherein a full face disc is formed by combining stamping and flow spinning operations. The method includes the steps of: (a) providing a generally circular rim defining an axis and including a generally axially extending well and a pair of opposed ends, one of the ends including an inboard tire bead seat retaining flange and an inboard tire bead seat, and the other end including an outboard tire bead seat; (b) providing a generally circular disc blank including an inner annular portion defining a wheel mounting surface; (c) stamping the disc blank to form an intermediate annular portion having a predetermined contour and an outer annular portion; (d) flow spinning the outer annular portion of the disc to form an outboard tire bead seat retaining flange of the full face wheel; (e) positioning the outboard tire bead seat retaining flange of the disc adjacent the outboard tire bead seat of the rim; and (f) securing the rim and disc together to produce the full face fabricated wheel.

4 Claims, 2 Drawing Sheets

METHOD FOR PRODUCING A FULL FACE FABRICATED VEHICLE WHEEL

CROSS REFERENCE TO RELATED APPLICATIONS

This application is a continuation-in-part of U.S. Pat. Ser. No. 08/054,373, filed Apr. 28, 1993 now U.S. Pat. No. 5,295,304, and herein incorporated by reference.

BACKGROUND OF THE INVENTION

This invention relates to an improved method for producing a full face fabricated vehicle wheel.

Full face fabricated wheels are becoming increasingly popular due to the enhanced styling they provide over conventional fabricated wheels. A full face fabricated wheel is distinguished from other types of fabricated wheels by having the appearance of a one-piece wheel disc construction.

A typical sequence of steps which can be used to produce a full face fabricated wheel includes the steps of: (a) providing a flat sheet of suitable material, such as aluminum or steel; (b) forming the sheet into a generally flat circular disc blank; (c) initially stamping the blank to form a partially-shaped disc; (d) progressively stamping the partially-shaped disc during a plurality of intermediate stamping operations to produce a disc having a predetermined shape; (e) final stamping an outer annular portion of the disc to form a bead seat retaining flange thereon which defines an outboard tire bead seat retaining flange of the finish full face wheel; (f) machining an outer edge of the outboard tire bead seat retaining flange of the disc; (g) trimming an end of the outboard tire bead seat retaining flange to provide a smooth tire side flange radius; and (h) securing the disc to a preformed rim to produce the finish full face fabricated wheel.

As a result of forming the full face wheel in this manner, the intermediate stamping operations produce a disc having a generally constant material thickness as the disc is progressively shaped. A slight thinning of the material occurs only at those portions of the disc where the curvature changes and forms a radius. Thus, the outer end of the outboard tire bead seat retaining flange of the disc must be machined to remove excessive material therefrom, in order to provide an end which is thin enough to allow a wheel balancing weight to be secured thereon.

It is known that a flat or a preformed disc blank can be tapered by a flow spinning process to produce a disc for a conventional or a combination wheel as disclosed in U.S. Pat. Nos. 3,823,591 to Schroder et al., U.S. Pat. No. 3,262,191 to Albertson et al., U.S. Pat. No. 3,195,491 to Bulgrin et al., and U.S. Pat. No. 2,983,033 to Cox.

SUMMARY OF THE INVENTION

This invention relates to an improved method for producing a full face fabricated vehicle wheel, wherein a full face disc is formed by combining flow spinning and stamping operations. In particular, after the stamping operations which form the generally constant thickness intermediate and outer annular portions, the disc is subjected to a flow spinning process to taper the outer annular portion thereof and form the outboard tire bead seat retaining flange of the full face wheel. The method for producing the full face wheel includes the steps of: (a) providing a generally circular rim defining an axis and including a generally axially extending well and a pair of opposed ends, one of the ends including an inboard tire bead seat retaining flange and an inboard tire bead seat, and the other end including an outboard tire bead seat; (b) providing a generally circular disc blank including an inner annular portion defining a wheel mounting surface; (c) stamping the disc blank to form an intermediate annular portion having a predetermined contour and an outer annular portion; (d) flow spinning the outer annular portion of the disc to form an outboard tire bead seat retaining flange of the full face wheel; (e) positioning the outboard tire bead seat retaining flange of the disc adjacent the outboard tire bead seat of the rim; and (f) securing the rim and disc together to produce the full face fabricated wheel.

Forming the full face wheel by this method results in a smaller diameter blank being originally used to produce the full face disc compared to a prior art full face disc which is produced solely by stamping. Also, combining stamping and flow spinning operations to produce the full face disc requires that the end of the outboard tire bead seat retaining flange only be trimmed to provide a smooth tire side flange radius. In the prior art, the outer end of the outboard tire bead seat retaining flange had to be machined to reduce the thickness thereof, then trimmed to provide a smooth tire side flange radius.

Other advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
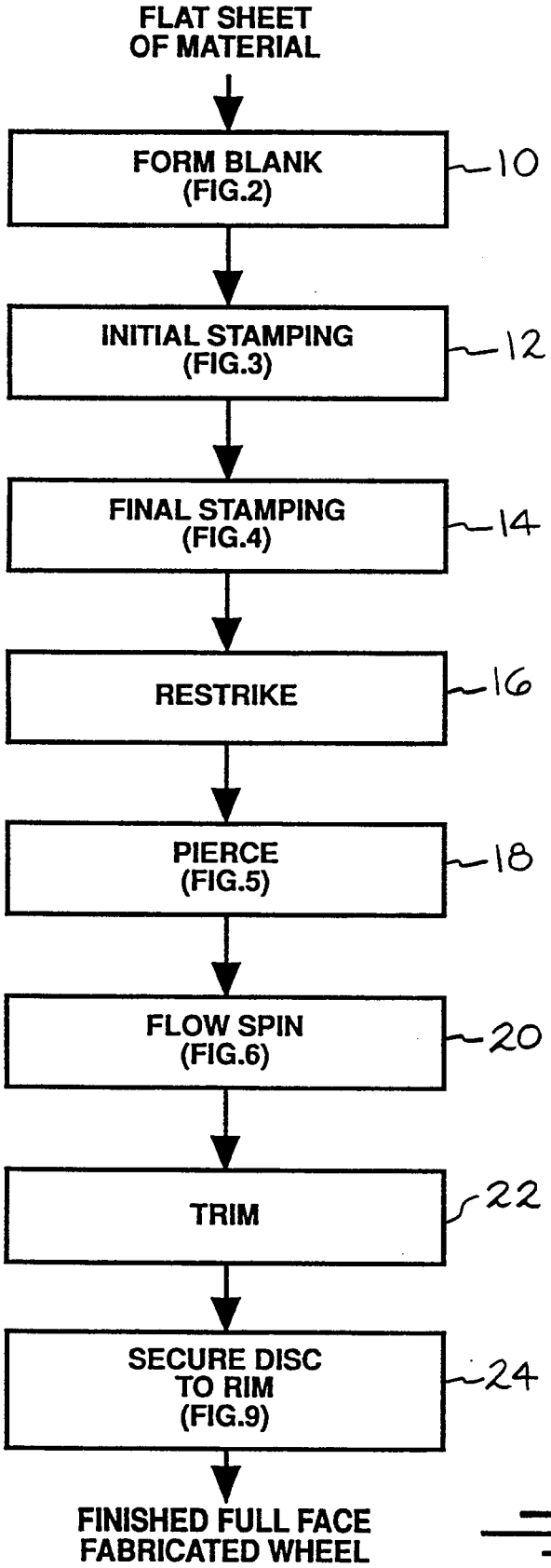
FIG. 1 is a block diagram showing a sequence of steps for producing a full face fabricated wheel constructed in accordance with the present invention.
Figure 2:
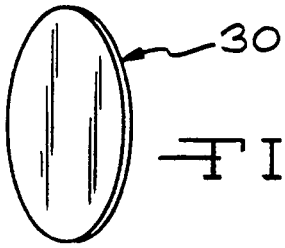
FIG. 2 is a perspective view showing the blank for use in producing the full face fabricated wheel.
Figure 9:
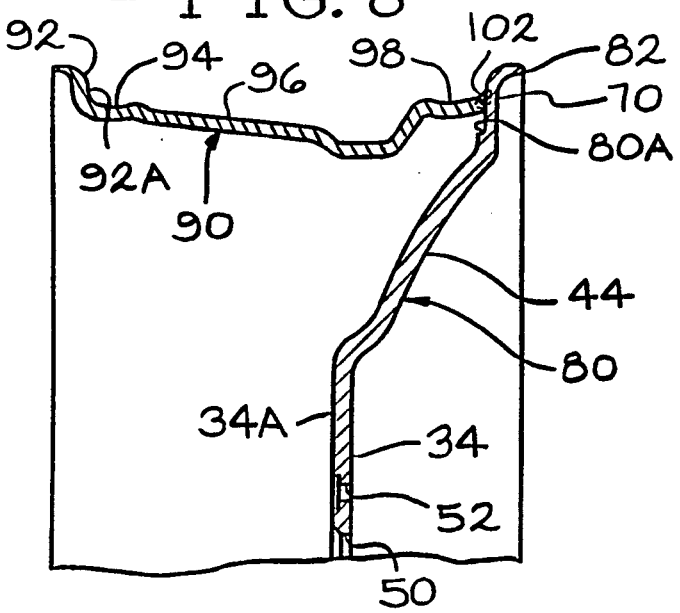
FIG. 9 is a partial sectional view of the finish full face fabricated wheel.

Referring now to the drawings, there is illustrated in FIG. 1 a block diagram showing a sequence of steps for producing a full face fabricated wheel, indicated generally at 100 in FIG. 9, and constructed in accordance with the present invention. Initially, in step 10, a flat sheet of suitable material, such as for example, steel or aluminum, is formed into a generally flat circular blank 30, as shown in FIG. 2.

Figure 3:
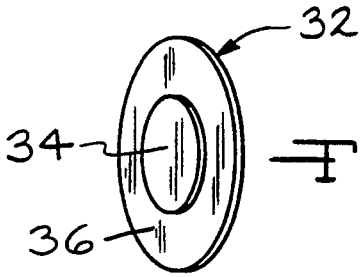
FIG. 3 is a perspective view showing the initial stamping of the blank into a partially-shaped disc.

Following step 10, the blank 30 is initially stamped in step 12 to produce a disc 32, shown in FIG. 3. The disc 32 includes an inner annular portion 34 which defines a wheel mounting surface, and which is offset from an outer annular portion 36.

Figure 4:
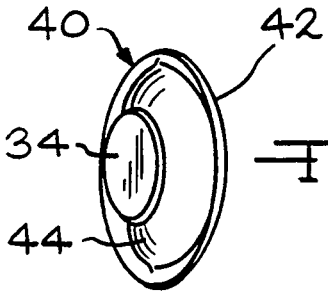
FIG. 4 is a perspective view showing the disc after a final stamping operation.
Figure 5:
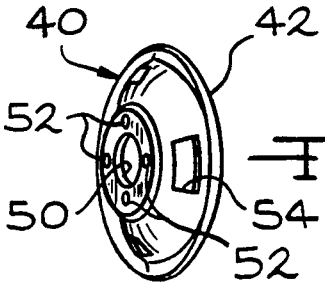
FIG. 5 is a perspective view showing the disc after a pilot aperture, lug mounting holes, and windows are formed therein.
Figure 7:
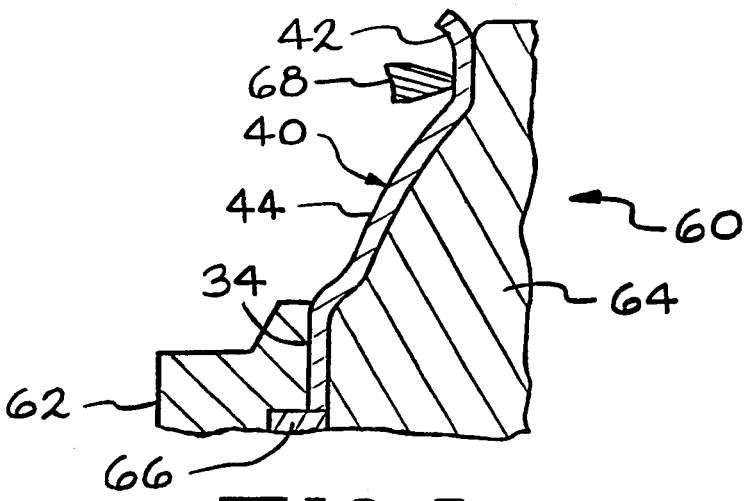
FIG. 7 is a partial elevational view of the disc prior to the flow spinning process.

Next, in final stamping step 14, the disc 32 is stamped to produce a bowl-shaped disc 40 having a predetermined contour, as shown in FIGS. 4 and 7. In particular, the bowl-shaped disc 40 includes the inner annular portion 34, a generally radially outwardly extending outer annular end portion 42, and a generally radially outwardly extending intermediate annular portion 44. As best shown in FIG. 7, the intermediate portion 44 extends radially outwardly in a first direction, and the outer annular end portion 42 extends radially outwardly in a second opposite direction. It will be appreciated that while final stamping step 14 is shown as a single stamping operation, depending upon the desired shape and/or the material of the blank 30, a series of stamping operations may be necessary to produce the disc 40.

After final stamping step 14, the inner annular portion 34 of the disc 40 is restruck in step 16. Next, during step 18, a pilot aperture 50, a plurality of lug receiving apertures 52, and a plurality of windows 54 are formed in the disc 40. The lug receiving apertures 52 are equally and circumferentially spaced in the disc 40 around the pilot aperture 50.

While four lug receiving apertures 52 are shown as being formed in the inner annular portion 34 of the disc 40, the actual number of lug receiving apertures 52 is determined by the particular axle assembly upon which the finished full face wheel is to be mounted. Also, the particular design, arrangement, and number of windows 54 which are formed in the disc 40 during step 16 can vary depending upon the desired final appearance of the disc. Furthermore, in some full face wheel designs, no windows 54 are formed in the disc.

Following step 18, the disc 40 is supported in a mandrel-tailstock assembly 60 and subjected to flow spinning process in step 20. The mandrel-tailstock assembly 60 is well known and includes a tailstock 62, and a spinning mandrel 64 having a centering pilot member 66.

The mandrel 64 is rotatably mounted on headstock (not shown) and is driven by a motor (not shown). The pilot member 66 is provided with a predetermined outer diameter which generally corresponds to the outer diameter of the pilot aperture 50 formed in the disc 40 to create a friction fit therebetween. Thus, when the disc 40 is supported on the mandrel-tailstock assembly 60, relative movement between the disc 40 and the mandrel-tailstock assembly 60 is restricted. As will be discussed below, an outer end portion of the mandrel 64 is provided with an outer surface having a predetermined contour which is effective to form a tire bead seat retaining flange of the full face disc during the flow spinning process of step 20.

In accordance with the present invention, once the disc 40 is supported in the tailstock-mandrel assembly 60, a spinning tool 68 is actuated in order to flow spin the outer annular end portion 42 of the disc 40 disc against the outer surface of the mandrel 64 in step 20. The spinning tool 68 is mounted on a support member (not shown) which allows the spinning tool 68 to generally travel parallel to the profile of the outer surface of the mandrel 64.

During the flow spinning process of step 20, the outer surface of the outer annular end portion 42 of the disc 40 is engaged by the end of the spinning tool 68 to make an initial cut, indicated at 80A in FIG. 9, in the disc 40. The initial cut 80A generally corresponds to the shape of the end of the spinning tool 68. The spinning tool 68 is then advanced in the direction of the arrow shown in FIG. 8 and the material of the disc 40 is pushed forward by the tool 68 into engagement with the adjacent outer surface of the mandrel 64. This movement results in increasing both the radial and axial dimensions of the disc 40 in the embodiment shown in FIG. 8 to form a generally radially outwardly extending outer annular end portion 70 which defines the outboard tire bead seat retaining flange of the full face wheel 100.

Figure 6:
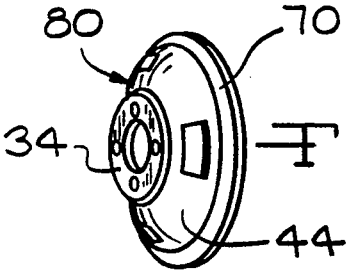
FIG. 6 is a perspective view showing the finished full face disc after a flow spinning process.
Figure 8:
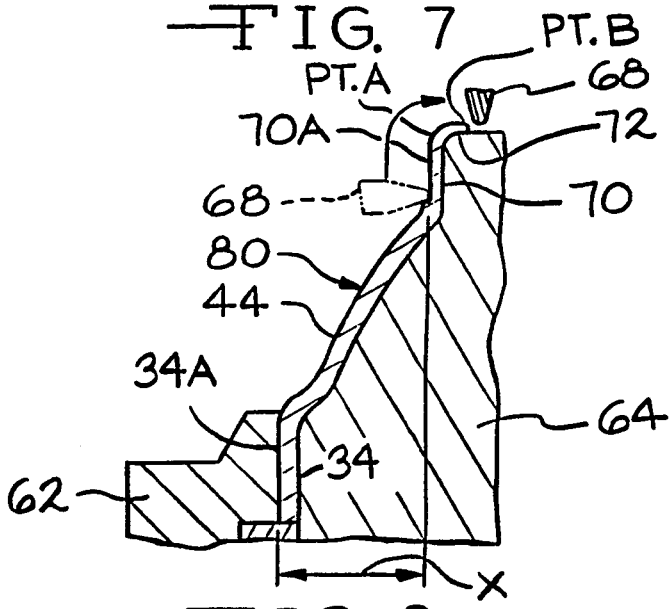
FIG. 8 is a partial elevational view of the disc after the flow spinning process is completed.

The flow spinning of the disc 40 in step 20 produces a wheel disc 80, shown in FIGS. 6, 8, and 9. The wheel disc 80 includes the radially extending wheel mounting surface 34, the generally radially outwardly extending intermediate annular portion 44, and the tire bead seat retaining flange 70. As shown in FIGS. 8 and 9, by forming the tire bead seat retaining flange 70 in this manner, an inner surface 70A of the tire bead seat retaining flange 70 is precisely located a distance X relative to an inner surface 34A of the inner annular portion 34 of the disc 80 in a parallel relationship, and an outer end portion 72 of the flange 70 is tapered from a Point A to a Point B. As will be discussed below, as a result of this, the disc 80 does not generally require any additional machining operations to remove material for the purpose attaching balancing weights (not shown) to the disc. All that is required is the outer end portion 72 of the outboard tire bead seat retaining flange 70 be slightly trimmed during step 22 to provide a smooth tire side flange radius.

After forming the outboard tire bead seat retaining flange 70 in the disc 80 during step 20 and performing trimming step 22, the finish full face disc 80 is then secured to a rim 90 having a predetermined shape in step 24. As shown in FIG. 9, the rim 90 includes an inboard tire bead seat retaining flange 92 having an outer surface 92A, and inboard tire bead seat 94, a generally axially extending well 96, and an outboard tire bead seat 98.

In particular, the outboard tire bead seat 98 of the rim 90 is positioned adjacent the outboard tire bead seat retaining flange 70 of the disc 80, and a circumferentially extending continuous, air-tight weld 102 is applied in step 24 to secure the rim 90 and disc 80 together to produce the finish full face fabricated wheel 100, shown in FIG. 9. Once the disc 80 and rim 90 are welded together in step 24, the tire bead seat retaining flange 70 of the disc 80 is effective to define the outboard tire bead seat retaining flange for the finish full face wheel 100. Also, the inner surface 70A of the outboard tire bead seat retaining flange 70, the inner surface 34A of the inner annular portion 34, and the outer surface 92A of the inboard tire bead seat retaining flange 92 are located parallel to one another and perpendicular relative to the axis of the wheel 100.

One advantage of the present invention is that by forming the full face wheel according to the method of the present invention, a smaller diameter blank is used to produce the full face disc 80 compared to the size of a blank used to produce a prior art full face disc formed solely by stamping. For example, according to the present invention, an 18.25 inch diameter blank can be used to produce a disc 60 for use in a 16×7 inch fabricated wheel, whereas an 19.75 inch diameter blank is needed to produce a similar sized disc which is produced according to the prior art stamping method. As a result of this, both the cost of the material and the weight of the full face disc, and therefore the full face fabricated wheel, of the present invention are less than the cost and weight of a prior art full face fabricated wheel.

Also, the outer portion 72 of the outboard tire bead seat retaining flange 70 can be tapered to a predetermined thickness during the flow spinning of step 20. As a result of this, the outboard tire bead seat retaining flange 70 includes an outermost end 82 which is thin enough to allow a wheel balancing weight (not shown) to be mounted thereon without generally requiring any additional machining to reduce the thickness thereof.

In the prior art stamping method, since the thickness of the material was generally constant throughout the entire disc, the outermost end of the outboard tire bead seat retaining flange had to be machined in order to reduce the thickness thereof, to allow a wheel balancing weight to be mounted thereon. This is important because a standard wheel balancing weight is designed to be mounted on the outermost end of a wheel having a maximum thickness of approximately 0.150 inches or less. Thus, a large amount of "scrap" material is removed from the prior art full face disc during the machining operation.

Also, the tapering of the disc 40 in step 20 by the flow spinning process is a cold working of the metal. As a result of this, the flow spinning process does not create excessive compressive stresses in the wheel disc material which require additional cold or hot working steps in order to relieve the stresses. In addition, the flow spinning process of step 20 results in optimum physical characteristics, i.e., strength and resiliency, in the finished disc 80 using a minimum amount of material. Prior art stamped discs added excessive material, and therefore weight, to portions of the disc where it is not required for strength. As a result of this, the material cost for producing a full face fabricated wheel 100 according to the method of the present invention is less than the material cost to produce a full face wheel according to the prior art method.

It will be appreciated that while the invention has been described and illustrated as using the flow spinning process of step 20 to both axially and radially increase the dimensions of the disc, the flow spinning process can be used to increase only the axial dimension of the disc. In addition, while the invention has been described and illustrated as forming the pilot aperture 50, the lug receiving apertures 52, and the windows 54 during step 18, these openings can be formed subsequent to step 20. Also, depending upon the desired finished disc profile, the outer surface of the mandrel can include other contours than the one shown in FIG. 7.

In accordance with the provisions of the patent statutes, the principle and mode of operation of this invention have been described and illustrated in its preferred embodiment. However, it must be understood that the invention may be practiced otherwise than as specifically explained and illustrated without departing from the spirit or scope of the attached claims.

What is claimed:

1. A method for producing a full face fabricated wheel comprising the steps of:

(a) providing a generally circular rim defining an axis and including a generally axially extending well and a pair of opposed ends, one of the ends including an inboard tire bead seat retaining flange and an inboard tire bead seat, and the other end including an outboard tire bead seat;

(b) providing a generally circular disc blank including an inner annular portion defining a wheel mounting surface;

(c) stamping the disc blank to form an intermediate annular portion having a predetermined contour and an outer annular portion;

(d) flow spinning the outer annular portion of the disc to form an outboard tire bead seat retaining flange of the full face wheel;

(e) positioning the outboard tire bead seat retaining flange of the disc adjacent the outboard tire bead seat of the rim; and (f) securing the rim and disc together to produce the full face fabricated wheel.

2. The method according to claim 1 wherein said step (c) includes stamping the disc blank to form a generally constant thickness intermediate portion and a generally constant thickness outer annular portion.

3. The method according to claim 1 wherein said step (d) includes flow spinning the disc blank to form a tapered outer annular portion.

4. The method according to claim 1 wherein the outboard tire bead seat retaining flange of the full face wheel includes an outermost end, and wherein prior to performing step (e), subjecting the outermost end to a trimming operation to provide the outermost end with predetermined tolerances.

* * * * *